US005540990A

United States Patent [19]

Cook

[11] Patent Number: 5,540,990

[45] Date of Patent: Jul. 30, 1996

[54] POLYOLEFIN LINE

[75] Inventor: Roger B. Cook, Spirit Lake, Iowa

[73] Assignee: Berkley, Inc., Spirit lake, Iowa

[21] Appl. No.: 428,485

[22] Filed: Apr. 27, 1995

[51] Int. Cl.[6] ..... D02G 3/00

[52] U.S. Cl. ..... 428/364; 57/234; 57/210; 57/250; 57/251; 43/44.98

[58] Field of Search ..... 428/364; 57/234, 57/210, 250, 251; 43/44.98

[56] References Cited

U.S. PATENT DOCUMENTS

| | | | |
|---|---|---|---|
| 3,702,055 | 11/1972 | Kosaka et al. | 57/157 |
| 3,908,509 | 9/1975 | Kelly et al. | 264/3.1 |
| 4,055,040 | 10/1977 | Lin | 57/140 |
| 4,137,394 | 1/1979 | Meihuizen et al. | 528/502 |
| 4,173,861 | 11/1979 | Norris et al. | 57/293 |
| 4,224,269 | 9/1980 | Reinhr et al. | 264/171 |
| 4,228,264 | 10/1980 | O'Neil | 57/210 |
| 4,297,835 | 11/1981 | Shimizu | 57/251 |
| 4,344,908 | 8/1982 | Smith et al. | 264/203 |
| 4,356,138 | 10/1982 | Kavesh et al. | 264/164 |
| 4,402,178 | 9/1983 | Negishi et al. | 57/205 |
| 4,413,110 | 11/1983 | Kavesh et al. | 526/348.1 |
| 4,422,993 | 12/1983 | Smith et al. | 264/210.8 |
| 4,455,273 | 6/1984 | Harpell et al. | 264/184 |
| 4,523,428 | 6/1985 | Negishi et al. | 57/288 |
| 4,539,805 | 9/1985 | Ukai et al. | 57/290 |
| 4,543,286 | 9/1985 | Harpell et al. | 428/288 |
| 4,551,296 | 11/1985 | Kavesh et al. | 264/177 |
| 4,563,392 | 1/1986 | Harpell et al. | 428/394 |
| 4,584,347 | 4/1986 | Harpell et al. | 525/119 |
| 4,819,458 | 4/1989 | Kavesh et al. | 28/166 |
| 4,876,774 | 10/1989 | Kavesh et al. | 28/166 |
| 4,897,902 | 2/1990 | Kavesh et al. | 28/166 |
| 4,980,957 | 1/1991 | Sussman | 28/244 |
| 5,135,804 | 8/1992 | Harpell et al. | 428/296 |
| 5,277,858 | 1/1994 | Neal | 264/210.8 |
| 5,340,523 | 8/1994 | Sussman | 264/205 |
| 5,342,567 | 8/1994 | Chen et al. | 264/203 |

FOREIGN PATENT DOCUMENTS

| | | |
|---|---|---|
| 0055001 | 12/1981 | European Pat. Off. . |
| 02-41760 | 10/1991 | Japan . |
| 02-188634 | 3/1992 | Japan . |
| WO93/24686 | 12/1993 | WIPO . |
| WO94/00627 | 1/1994 | WIPO . |

OTHER PUBLICATIONS van Hutten et al., "shishi–kebabs as an Intermediate Morphology in Gel –Spinning/Hot Drawing of Polyethylene", *Polym. Comm.*, 24, pp. 237–240 (1983).

Hoogsteen et al., "The Influence of the Extraction Process and Spinning Conditions on Morphology and Ultimate Properties of Gel–Spun Polyethylene Fibers", *Polymer*, 28, pp. 923–928 (1987).

Hoogstein et al., "Gel Splun Polyethylene Fibers: Part I—Influence of Spinning Temperature and Spinline Stretching on Morphology and Properties", *J. Mat. Sci.*, 23(10), pp. 3459–3466 (1988).

Hoogsteen et al., "DSC Experiments on Gel–Splun Polyethylen Fibers", *Colloid Polym. Sci.* 266(11) 1003–1013 (1988).

Hoogsteen et al., "SAXS Experiments on Voids in Gel–Splun Polyethylene Fibres", *J. Mater. Sci.*, 25(3) 1551–1556 1990.

Hoogsteen et al., "SAXS Experiments on Gel–Splun Polyethylene Fibers", *Colloid Polym. Sci.*, 268(3) 245–255 (1990).

Tzou et al., "Two Dimensional $^{13}$CN.M.R. Studies of the Morphology and Orientational Order in Gel–Splun Ultrahigh Molecular Weight Polyethylene Fibres", *Polymer*, 33(2) 426–428 (1992).

Choy et al., "Thermal Conductivity of Gel Splun Polyethylen Fibers", *J. Pol. Sci.*, 31(3) pp. 365–370 (1993).

Gibbs, "A New Twist For Line", *Outdoor Life* 192(5) p. 65 (Nov. 1993).

*Fishing Tackle Retailer*, Feb. 1995, p. 20.

*Primary Examiner*—Newton Edwards
*Attorney, Agent, or Firm*—Banner & Allegretti

[57] ABSTRACT

Monofilament lines are made from twisted gel spun polyolefin yarns that are heated and stretched under conditions sufficient to fuse adjacent filaments into a line having monofilament characteristics and high tenacity.

8 Claims, No Drawings

POLYOLEFIN LINE

FIELD OF THE INVENTION

The present invention relates to the stretching of braids or twisted and plied yarns made of high tenacity, ultrahigh molecular weight filaments, fibers or yarns.

BACKGROUND OF THE TECHNOLOGY

Ultrahigh molecular weight, high tenacity filaments based on spun polyolefins are described in numerous patents, published patent applications, and technical articles. Exemplary references include Kavesh et al. U.S. Pat. No. 4,413,110; Smith et al. U.S. Pat. No. 4,344,908; Smith et al. 4,422,993; Kavesh et al. U.S. Pat. No. 4,356,138; Maurer EP 55,001; Harpell et al. U.S. Pat. No. 4,455,273; Kavesh et al. U.S. Pat. No. 4,897,902; Neal U.S. Pat. No. 5,277,858; and Kirkland et al. WO 94/00627.

These filaments are generally made from linear polyethylene or polypropylene chains of a molecular weight of at least 400,000, a tenacity of at least 15 grams per denier (g/d), a tensile modulus of at least 500 g/d (nylon monofilaments are about 20–50 g/d), a melting point of at least 140° C., have high abrasion resistance, low stretch, high toughness, good dimensional and hydrolytic stability, and high resistance to creep under sustained loads. The yarns are opaque and white in appearance. Such yarns are commercially available from Allied-Signal, Inc., Morris, N.J. as SPECTRA fiber and from DSM, NV, Netherlands under the name DYNEEMA. The filaments in these commercial yarns has a significantly higher molecular weight than 400,000.

Both SPECTRA and DYNEEMA filaments are fundamentally made in the same way. A solution containing polyethylene gel swelled with a suitable solvent is spun into filaments of high molecular weight polyethylene. The solvent is removed, and the resulting yarn is stretched or "drawn" on one or more stages. In general, such filaments are known in the art as "gel spun polyolefins" with gel spun polyethylene being the most commercially sold.

Monofilament fishing lines of high molecular weight, gel spun polyolefin filaments in sufficient diameter are not commercially available. The most likely reason is that the filament manufacturing process involves quantities of solvent that must be removed from the filament following its formation. Thicker filaments would hinder the efficiency and completeness of the solvent removal process and aversely affect the strength of the finished filament. In addition, there are concerns for the degree of limpness such lines might have as well as the handling characteristics of such lines in real fishing conditions.

Fishing lines must be reasonably limp to be effective under the conditions of normal fresh and salt water fishing. For example, the bending modulus of nylon monofilaments is within the range from about 15–50 g/d. The high molecular weights characteristic of gel spun polyolefins, however, make the line unacceptably stiff at the diameters generally required for fishing lines, if such lines could be produced. Monofilaments from such materials would not wind onto a conventional reel easily and would be difficult to tie into knots, such as those used to secure a lure to the line, without weakening the line and jeopardizing the quality of the knot.

It would be desirable to have a fishing line from gel spun polyolefins that was sufficiently limp like monofilaments to use for fresh and salt water fishing with conventional fishing equipment and lures.

Fishing lines made from braids of gel spun polyethylene yarns have been introduced into competition with conventional braided fishing line materials (generally polyesters) and nylon monofilament lines. The higher strength of such braided polyethylene lines is a distinct advantage. Such braids can, however, exhibit some disadvantageous characteristics.

Monofilament lines are generally more preferred for bait casting, spinning, and spin casting. Monofilaments have a round, firm structure that makes for more convenient handling. The stiffer nature of the line and the smoother surface combine to reduce drag during the cast and enable longer casts while providing a better release from a fishing reel. Monofilament lines do not entrap water and do not present an outer surface that is vulnerable to snags and entanglement.

Braided lines can also have the tendency to fray at the end of the line. When tied into a knot, this "tag end" frays to create a fuzzy protrusion that can adversely affect the appearance and acceptability of a lure when fishing. In addition, braided lines made from gel spun polyethylenes cannot be cut cleanly with a compression type of line clipper that is commonly in use among anglers. The braid must be cut with a scissors or other type of shearing device to ensure that all filaments in the braid are severed evenly.

It would be desirable to have a line with the high tenacity of gel spun polyolefin lines that is more monofilament-like in its handling characteristics, i.e., the line has a firm structure like that of a monofilament, exhibits a lower diameter than a braid, does not saturate with water, and reduces or eliminates the problems associated with end fraying and the difficulties of cutting the line.

Braided or twisted lines made of gel spun polyolefin yarns are also characterized by an opaque white color (i.e. , no light transmittivity). White is not, however, the preferred color for use in a fishing line. There is a belief that white lines are too visible below water and will tend to scare fish from a bait or lure.

It would be useful to have a process for providing a gel spun polyolefin line that exhibited a nonopaque appearance, preferably a translucent to more adequately hide the line when under water.

SUMMARY OF THE INVENTION

It is an objective of the invention to provide a yarn from gel spun polyolefins that exhibits low end fraying and cutting characteristics similar to conventional monofilaments.

It is another objective of the invention to provide a fishing line made from gel spun polyolefin filaments that is stiffer than a twisted or braided line yet sufficiently stiff to exhibit reel handling (loading and unloading) characteristics like monofilament lines.

It is a further objective of the invention to provide a fishing line from gel spun polyolefin that is at least partially translucent and less visible in water than previous opaque white lines from gel spun polyolefin.

In accordance with this and other objectives of the invention that will become apparent from the description herein, lines according to the invention are made by a process comprising: exposing an opaque braided or twisted line made from gel spun polyolefin filaments to a temperature within the melting point range of said polyolefin for a time sufficient to at least partially fuse the contact surfaces of adjacent filaments. For gel spun polyethylene, the temperature is preferably within the range from about 150°–157° C.

Lines made according to the invention impart desired handling characteristics of monofilament in ultrahigh molecular weight, gel spun polyolefin braided or twisted lines while affording the benefits of high strength characteristic of the gel spun polyolefin materials. Casting is improved over braids. The line exhibits a harder, stiffer, lower friction surface than braids or twists which leaves the reel and moves through the guides with less drag. The line also exhibits low fraying and is easier to cut with conventional clippers. The low stretch character of the resulting line translates into a fishing line with a high degree of sensitivity.

DETAILED DESCRIPTION OF THE INVENTION

Gel spun polyolefin yarns are braided or twisted into a line and then subjected to a further stretching at an elevated temperature within the melting point range of the filament material that is sufficient to at least partially fuse the contact surfaces of the individual filaments within the yarn into a line having monofilament-like characteristics. The unfused surfaces permit the line to retain filament mobility and limpness while the fused surfaces secure the individual filaments to prevent end fraying and permit cutting with conventional compression cutting devices.

The conditions of the fusion process according to the present invention are selected to be high enough and for a sufficient residence time to soften the filaments and allow them to fuse at least partially within a braided or twisted line structure. Conditions useful for the surface fusion process include a temperature or series of oven temperatures within the melting point range of the filament polymer that allows for adequate fusion during the exposure period. The temperature is preferably within the range from about 150° C. up to about 157° C. for high molecular weight, gel spun polyethylene yarns exhibiting a relaxed melting point range of 138° to about 162° C. at a 20° C./minute scan rate. Residence times during which the line is exposed to the fusion temperature are within the range from about 6 seconds to about 150 seconds. Although a higher degree of fusion is achieved by increasing the temperature, there is a corresponding loss in tenacity as the fusion temperature (e.g., the set point temperature of the heating ovens) is increased.

It should be noted that the effect of increasing temperature appears to predominate over the length of the residence time at the applied fusion temperature. In other words, a change in oven temperature will have a more pronounced effect than a change in residence time through the fusion ovens.

Following the fusion process, lines according to the invention change their appearance from an initial, opaque white color (0% light transmission) characteristic of the virgin filaments into a nonopaque appearance. In particular, the filaments take on a translucent, milky, or substantially transparent surface having a range of light transmittivity from about 1% to about 100%, preferably within the range from about 2% to about 50%. Such an increase in light transmission helps to conceal the line underwater.

Only the outer surface of the filaments should soften and begin to fuse as seen by an increase in light transmission as the degree of fusion progresses. The change in light transmission is visible to an observer as the line exits from an oven between unheated stretching rollers or as it leaves a heated stretching roller. As the light transmission character of the outer surfaces increases (i.e., the line becomes more clear), however, the line becomes stiffer and more like a monofilament. The fused surface contacts provide the line with monofilament-like character in terms of low end fraying and convenient cutting with crushing style clippers.

The line is also heated while stretching (sometimes referred to in the art as "drawing") the line under tension that is preferably applied continuously. The stretching tension provides a number of benefits: (1) tension prevents loss of tenacity at the fusion temperatures; (2) tension preserves or increases the tenacity of the fused structure relative to the unfused braided or twisted line; (3) tension helps to compress the structure radially for better fusion; and (4) tension prevents melting.

Preferably, the temperature, residence time, and stretching ratio at the selected temperature are chosen to provide a line exhibiting some degree of light transmission and a tensile modulus within the range from about 230 g/d to about 780 g/d with a tenacity of at least 15 g/d, and more preferably a tenacity of at least 25 g/d. Significant reductions in the line tenacity indicate that the combination of temperature and residence time are too high and are resulting in loss of filament orientation.

A simple test can be used to determine whether adjacent fiber surfaces are fusing. Line with a sufficient number or concentration of surface fused fibers is mounted on a slide. A permanent marker is held vertically and contacted at a stationary position for 5–10 seconds. A regular, braided line will wick color from the marker into the line surface. A sufficiently fused line will not wick color from beyond the contact area.

Alternatively, an optical microscope can be used to observe whether the filaments or yarns will readily separate when subjected to compression. Insufficiently fused lines will readily separate. Sufficient fusion exists when the line does not readily separate and a series of compression/tension cycles is needed to begin to separate the filaments or yarns from the line.

Preferably, the present fusion conditions also include an overall stretching ratio from one or more stages of stretching to preserve or increase chain orientation. Such stretching ratios are generally within the range from about 1.01 to about 2.5 and preferably a ratio within the range from about 1.35 to about 2.2.

The fusion process conditions place the outer surface temperature of the filaments at or within the melting point range of the polymer in the filaments so that filament surfaces begin to soften and fuse at contact points along the outer surfaces of the filaments. The fusion conditions are chosen to maintain a line tension reflective of centerline chain reorientation and avoid loss of filament orientation.

The non-opaque outer surface of the gel spun polyolefin line of the invention is better capable of blending into the background colors under water without colorants. A clear outer surface is most able to be self-camouflaging. If colored, the improved transmission of light provides an outer surface that is more readily colored than the virgin opaque, white surface.

The lines of the invention may be made from colored yarns, colored after braiding or twisting, or after fusion according to the present invention. Penetrating coloring solutions that can be employed in the color-imparting process include: aqueous solutions of ethylene-acrylic acid copolymers, low molecular weight polyethylenes, low molecular weight ionomers, high molecular weight ionomers, and polyurethanes; and dyes or pigments in organic solvents or mineral oils (especially those with a molecular weight of 200–700 that will penetrate the filament). A preferred coloring agent is an aqueous solution containing ethylene-acrylic acid copolymer containing a blue or green dye or pigment.

Coloring agents can be applied by passing the line of the invention through a bath containing the coloring solution at room temperature, e.g., a temperature within the range from about 20° C. to about 25° C., although higher temperatures can be used if desired. Thereafter, the coated line is dried and the coloring agent set by passing the coated line through an oven maintained at a temperature within the range from about 100° C. to about 130° C.

The gel spun polyolefin yarns used in the invention are preferably made from filaments of ultrahigh molecular weight, high tenacity polyethylene or polypropylene. Such filaments are characterized by a molecular weight of at least 400,000 and more preferably at least about 800,000; a tenacity of at least 15 g/d; a tensile modulus of at least 500 g/d; and a melting point of at least 140° C. See, Kavesh et al. U.S. Pat. Nos. 4,413,110 and 4,551,296 the disclosures of which are herein incorporated by reference.

The polyolefin can contain one or more fillers. Exemplary fillers include magnetic materials, electrically conductive substances, substances with high dielectric constant, and mixtures thereof can be used if desired. Specific examples include calcium carbonate, barium carbonate, magnesium carbonate, clay, talcum, mica, feldspar, bentonite, aluminum oxide, magnesium oxide, titanium dioxide, silica, gypsum either uncoated or coated with another material to enhance the bond between the polymer and the filler, e.g., stearic acid or acrylic acid. See, Maurer EP 55,001.

Braided lines according to the invention are made with conventional braiding equipment and 3–16 discrete yarns braided about a central axis. The braid tightness (measured in "picks per inch") is adjusted to provide a limp line of good surface quality according to the prevailing standards of the line manufacturer. The braids used as feed to the present fusion process preferably exhibit a size within the range from about 100 denier to about 3000 denier and more preferably within a range from about 200–800 denier.

Twisted lines of the invention can be made from either single, twisted yarns or in 2–4 ply, torque-balanced structures. Preferably, the line is twisted to produce a neutral net twist, i.e., the twisted fibers will remain intertwined even when free of tensile loading. In the conventional language of the art, single yarns are twisted in a "z" direction, while 2–4 of these z-twisted yarns can then be plied together in the "s" (opposite) direction. The "z" pitch and "s" pitch are chosen to balance the torque of each twist. Twists are measured in terms of "twists-per-inch" (tpi) or "twists-per-meter" (tpm). Like the braids, twists used as feed to the present fusion process preferably exhibit a size within the range from about 100 denier to about 3000 denier and more preferably within a range from about 200–1200 denier.

One or more outer coating materials can be applied to the surface of the line, yarn, or filament to enhance the fusion process between the fiber polymer of adjacent filaments. Such coatings include mineral oils (e.g., heat transfer grade mineral oils with an average molecular weight of 250–700) paraffin oils, and vegetable oils (e.g., coconut oil). Contact between the line or yarn and the coating material can be performed under ambient conditions (e.g., 20°–25° C.) or under elevated temperatures (e.g., up to about 100°–150° C. or higher). Mineral oil acts as a plasticizer that enhances the efficiency of the fusion process permitting the fusion process to be performed at lower temperatures. Such enhanced efficiency is exhibited regardless of the structure into which the filaments, yarns, or lines is made, e.g., fabrics, composites, or ballistic apparel.

EXAMPLES

The following examples were performed in one of two heated production lines made with three ten foot ovens wherein the last two ovens are end-to-end and stretching rollers are located after the first oven and following the last in the "double length" oven. Unless otherwise stated, all temperatures are in degrees Celsius.

Examples 1–9

Braided and twisted lines made from yarns of gel spun polyethylene filaments were prepared and subjected to the fusion process of the present invention. Total draw ratios were within the range of 1.8–1.9 with a higher draw ratio on the first roller than on the second. Each of the examples formed a line with monofilament-like characteristics and good tenacity values. (For comparison, conventional polyester-based braids generally have tenacity values of less than 8, usually about 6–7 g/d, and nylon braids exhibit tenacity values of about 5–6 g/d.) Examples 8 and 9 were performed with braided lines that were previously coated with ethylene acrylic acid copolymer resin (EAA) containing a green pigment. A summary of the conditions and results are shown in Tables 1 and 2.

TABLE 1

| | 1 | 2 | 3 | 4 |
|---|---|---|---|---|
| Construction | Braid (2 × 100, 2 × 200) | Braid (4 × 200) | Braid (4 × 200) | Braid (2 × 100, 2 × 200) |
| Initial Denier | 645 | 860 | 860 | 645 |
| Rate (fpm) | 30 | 30 | 30 | 30 |
| Oven 1 Temp | 150 | 150 | 150 | 150 |
| Oven 2 Temp | 155 | 154 | 154 | 154 |
| Draw Ratio 1 | 1.4 | 1.4 | 1.5 | 1.5 |
| Draw Ratio 2 | 1.36 | 1.36 | 1.27 | 1.27 |
| Total DR | 1.9 | 1.9 | 1.9 | 1.9 |
| Final Denier | 332.2 | 449.8 | 445.4 | 333.7 |
| Elongation (%) | 3.3 | 2.7 | 2.6 | 3.1 |
| Break Strength (lb) | 20.9 | 25.8 | 27.2 | 23.6 |
| Knot Strength (lb) | 14.7 | 18 | 20.4 | 17.4 |
| Tenacity (g/d) | 28.5 | 26 | 27.7 | 32.1 |

TABLE 2

| | 5 | 6 | 7 | 8 (EAA) | 9 (EAA) |
|---|---|---|---|---|---|
| Construction | Braid (4 × 100) | Braid (3 × 50, 1 × 100) | Braid (4 × 50) | Braid (4 × 200) | Braid (4 × 200) |
| Initial Denier | 430 | 260 | 295 | 945 | 945 |
| Rate (fpm) | 30 | 30 | 30 | 20 | 20 |
| Oven 1 Temp | 150 | 150 | 150 | 152 | 150 |
| Oven 2 Temp | 154 | 154 | 154 | 154 | 152 |
| Draw Ratio 1 | 1.4 | 1.4 | 1.4 | 1.4 | 1.4 |
| Draw Ratio 2 | 1.36 | 1.36 | 1.36 | 1.286 | 1.286 |
| Total DR | 1.9 | 1.9 | 1.9 | 1.8 | 1.8 |
| Final Denier | 225.9 | 141.2 | 114.2 | 524.6 | 513.3 |
| Elongation (%) | 2.9 | 2.9 | 3.1 | 3 | 2.8 |
| Break Strength (lb) | 15.7 | 9.7 | 8 | 28.1 | 31.2 |
| Knot Strength (lb) | 12.1 | 7.6 | 5.6 | 16.5 | 20.8 |
| Tenacity (g/d) | 31.5 | 31.2 | 31.8 | 24.3 | 27.6 |

Differences in braid construction and line size did not adversely affect the nature of the fusion process. Tenacity values were within acceptable ranges and variances.

Examples 10–13

In examples 10–13, mineral oil was used as a plasticizer and fusion enhancer. In examples 10 and 12, the mineral oil contained a dye. In examples 10–13, the braided lines were dipped in mineral oil for about 1 second and wiped with a squeegee to remove excess oil. Oil was observed to wick into the braid immediately upon contact with the oil. The line then fed to and through the fusion line ovens and rollers, a time period during which the oil was believed to continue to penetrate into the yarns of the braid. If used, mineral oil within a range from about 1% to about 30%, preferably about 1–25%, and more preferably within the range of about 1–20% should be used as measured by heptane extraction of the final, processed line. Table 3 reports the results.

TABLE 3

| | 10 (19.3% Min. Oil) | 11 (12.7% Min. Oil) | 12 (12.7% Min. Oil) | 13 (14.6% Min. Oil) |
|---|---|---|---|---|
| Construction | Braid (4 × 200) | Braid (2 × 100, 2 ×°200) | Braid (2 × 100, 2 × 200) | Braid (2 × 100, 2 × 200) |
| Initial Denier | 860 | 645 | 645 | 645 |
| Rate (fpm) | 20 | 20 | 20 | 10 |
| Oven 1 Temp | 152 | 148 | 148 | 148 |
| Oven 2 Temp | 154 | 152 | 152 | 152 |
| Draw Ratio 1 | 1.4 | 1.4 | 1.4 | 1.4 |
| Draw Ratio 2 | 1.286 | 1.36 | 1.36 | 1.36 |
| Total DR | 1.8 | 1.9 | 1.9 | 1.9 |
| Final Denier | 569.4 | 372 | 380.4 | 374 |
| Elongation (%) | 1.9 | 2.5 | 2.5 | 2.3 |
| Break Strength (lb) | 17.1 | 22 | 21.8 | 20.6 |
| Knot Strength (lb) | 9.4 | 16.6 | 16.4 | 16.1 |
| Tenacity (g/d) | 13.6 | 26.8 | 26 | 25 |

The mineral oil did improve the ease of fusion and the quality of the monofilament characteristics in the resulting line. The plasticized line was more flexible and well fused. The tenacity values were, however, somewhat lower although still acceptable.

Example 14

A braided yarn of gel spun polyethylene was stretched at a draw ratio of 1.9:1 at 152° C. The structure became semi-fused but could be delaminated back to the original four yarns by cyclic abrasion over a sharp corner. For comparison, the braided yarn of the same material was then passed through a heat transfer grade mineral oil (avg. MV of 350), then stretched and processed at 152° C. The braid became fused, greatly reducing delamination characteristics and nearly maintained the properties of the drawn, braided structure.

Example 15

Twisted yarns of gel spun polyethylene filaments of single ply and four ply constructions with an initial denier of 400 were drawn at a ratio of 1.3–1.4 at 152° C. The drawn structure was loosely fused and was easily delaminated by flexing the structure. For comparison, single ply and four ply structures of the same materials and size were then passed through the mineral oil bath used in example 14, stretched, and processed at 152° C. The twisted structures became completely fused and maintained most of the desired properties in the original twisted structures yet adding a monofilament-like handling characteristic.

Example 16

Untwisted gel spun polyethylene yarns were stretched at ratios of 1.3–1.45:1 at 152° C. The yarn showed little signs of fusion. For comparison, untwisted yarn was passed through the mineral oil of example 14, stretched, and fused at 152° C. The yarns formed a fused structure with monofilament-like handling characteristics and nearly the strength of the original stretched yarn.

Examples 17–18

In examples 17, a line was made from four yarns by twisting and plying. The resulting line exhibited a neutral twist and was used as feed to a fusion process according to the invention. Table 4 reports the process conditions and physical characteristics of the resulting fused line.

TABLE 4

| | 17 | 18 |
|---|---|---|
| Construction | Twist 4 × 100, twist 700 t/m "z", ply 350 t/m "s" | |
| Initial Denier | 412.4 | |
| Rate (fpm) | 25 | control |
| Oven 1 Temp | 148 | |
| Oven 2 Temp | 154 | |
| Draw Ratio 1 | 1.4 | |
| Draw Ratio 2 | 1.268 | |
| Total DR | 1.8 | |
| Final Denier | 235.2 | 412.4 |

TABLE 4-continued

| | 17 | 18 |
|---|---|---|
| Elongation (%) | 3.1 | 4.2 |
| Break Strength (lb) | 12.5 | 21.6 |
| Knot Strength (lb) | 8.3 | 15.5 |
| Tenacity (g/d) | 24.1 | 23.8 |

The lines made from twisted yarns fused well and did not exhibit a loss of tenacity. Reductions in break strengths were due to a drop in the line denier from 412.4 to 235.2.

The examples presented herein are intended for illustration purposes only and are not intended to act as a limitation on the scope of the appended claims.

I claim:

1. A yarn comprising:

at least two gel spun polyolefin filaments exhibiting a molecular weight of at least 400,000 that have been coated with a coating material that enhances fusion between said at least two said filaments and exposed to a temperature within the melting point range of said filaments for a time sufficient to soften and fuse surfaces of adjacent filaments whereby fused surfaces secure individual filaments together.

2. A yarn according to claim 1 wherein said yarn exhibits a light transmission within the range from about 2% to about 50%.

3. A yarn according to claim 1 wherein said coating material is selected from the group consisting of mineral oil, paraffin oil, and vegetable oil.

4. A yarn according to claim 1 wherein said coating material is a mineral oil having an average molecular weight within the range of 250–700.

5. A yarn according to claim 1 wherein said coating material is 1–30% by weight of a mineral oil.

6. A yarn according to claim 1 wherein said yarn is colored.

7. A line according to claim 1 wherein said yarn is colored by a passing said line through a color-imparting solution comprising a pigment or dye in a mineral oil.

8. A yarn according to claim 1 wherein said coating material is a paraffin oil.

* * * * *